US006128866A

United States Patent [19]

Wearne

[11] Patent Number: 6,128,866

[45] **Date of Patent: *Oct. 10, 2000**

[54] IDENTIFYING PREFABRICATED EXTERIOR SIDING AND RELATED TRIM ITEMS

[76] Inventor: John R. Wearne, 115 Birklands Dr., Cary, N.C. 27511

[ * ] Notice: This patent issued on a continued prosecution application filed under 37 CFR 1.53(d), and is subject to the twenty year patent term provisions of 35 U.S.C. 154(a)(2).

[21] Appl. No.: 08/744,881

[22] Filed: Nov. 8, 1996

[51] Int. Cl.[7] ..... E04F 13/00

[52] U.S. Cl. ..... 52/105; 52/530

[58] Field of Search ..... 52/105, 529, 530, 52/531; 156/277

[56] References Cited

U.S. PATENT DOCUMENTS

| | | | |
|---|---|---|---|
| 3,835,604 | 9/1974 | Hoffmann, Jr. | 52/105 |
| 4,015,374 | 4/1977 | Epstein et al. | 52/57 |
| 4,015,391 | 4/1977 | Epstein et al. | 52/520 |
| 4,233,100 | 11/1980 | Cunningham et al. | 156/260 |
| 4,320,613 | 3/1982 | Kaufman | 52/521 |
| 4,476,661 | 10/1984 | Hoofe, III | 52/546 |
| 4,649,008 | 3/1987 | Johnstone et al. | 264/177.1 |
| 5,203,941 | 4/1993 | Spain et al. | 156/209 |
| 5,239,802 | 8/1993 | Robinson | 52/518 |
| 5,461,839 | 10/1995 | Beck | 52/519 |
| 5,526,627 | 6/1996 | Beck | 52/519 |
| 5,651,227 | 7/1997 | Anderson | 52/520 |

*Primary Examiner*—Michael Safavi
*Attorney, Agent, or Firm*—Rhodes & Mason, PLLC

[57] ABSTRACT

An exterior building component for installation on a building. The component includes at least a portion thereof being of a prescribed color, the color corresponding to a manufacturer or supplier, whereby the component may be identified as a product of the manufacturer or supplier. Also, a method for forming an exterior building component which may be identified as corresponding to a manufacturer or supplier in the absence of associated packaging. A colored portion is formed on the component, the color of the colored portion corresponding to the manufacturer or supplier, whereby the component may be identified as a product of the manufacturer or supplier. Further, a method of providing exterior building component identification for distribution under multiple brands. A different color is selected for each of the brands. A strip of colored material is applied to each exterior building component, the color of the strip being that of the respective brand through which the respective exterior building component is to be distributed.

17 Claims, 4 Drawing Sheets

IDENTIFYING PREFABRICATED EXTERIOR SIDING AND RELATED TRIM ITEMS

FIELD OF THE INVENTION

The present invention is directed to a method and means for identifying vinyl and aluminum siding, soffits, gutters, downspouts, window lineals, gable louvers, shutters and other trim items used to complete the installation of exterior siding on a building, and, more particularly, to such a method and means wherein the means for identifying is visible after the siding or other noted item is separated from its associated packaging but is not visible from the exterior of the building when the siding or other item is installed on the building.

BACKGROUND OF THE INVENTION

The use of vinyl and aluminum siding, soffits, gutters, downspouts, window lineals, gable louvers, trim corners, shutters and related trim items for the exterior covering of residences and commercial buildings has expanded greatly in the last several years. Many different manufacturers produce and market such siding. Most siding products look nearly identical, particularly from a distance. Only the most experienced product managers and applicators are able to distinguish one manufacturer's product from another or one product in a manufacturer's line from another product in the manufacturer's line, even on close examination. Nonetheless, the products are not identical; minor differences exist in shape, finish, color and ingredients. Although the similarities between different manufacturers' siding products can make it difficult to identify siding products from different manufacturers, after installation one experienced in the industry can usually detect differences in fit, finish and color if such mixing of products occurs. A similar problem is experienced with roofing shingles.

Typically, the only indication as to the manufacturer, brand, supplier and style of a given panel of siding is the carton or other packaging in which the panel is supplied. Distributors frequently stock multiple brands which may inadvertently be shipped to the applicator at one jobsite. Applicators frequently express frustration with the fact that, after the siding panels have been removed from the carton, there is no readily visible way to distinguish one manufacturer's or supplier's siding products from the siding products of another. Sometimes the differences between siding products are not detectable until after the applicator has mistakenly mixed and hung products of different manufacturers or suppliers. This is a time-consuming and expensive mistake to rectify. Moreover, subsequent matching of siding by a homeowner or contractor making repair, replacement, or additions to the siding is difficult and inconsistent. Brand confusion by the consumer at retail and from in-home presentations is a normal occurrence.

Heretofore, certain techniques have been used with limited success to identify a siding product's manufacturer, supplier and/or style after the product has been removed from the carton. Some manufacturers emboss or heat-stamp a lot number or run number across the nail hem or the locking system lip of the panel, which is not visible after completion of the installation. Unfortunately, the embossed indicia blends into the wood grain embossed on the siding and, in any event, does not provide any color contrast. As a result, the lot numbers and run numbers are difficult to read, even up close, and are virtually impossible to read from a distance of greater than about an arm's length.

Another visual indicator used to identify a siding product's manufacturer or supplier is the shape or style of the wood grain embossed on the siding. This method of identification requires, of course, a highly-trained and experienced eye. Moreover, different manufacturers' wood grain embossments can look very similar. In fact, they are often identical because a number of siding manufacturers use the same embossing tools from a common source.

Finally, a siding product's manufacturer may sometimes be identified by the shape of the "weep hole" on the bottom edge of the siding. However, most siding manufacturers use one of only a few variations in the shape of the weep hole (i.e., round, square or heart-shaped).

Thus, there exists a need for an effective means for identifying the manufacturer, supplier and/or style of exterior siding and related items which provides a visible indicator after the siding or other item has been removed from its associated packaging, but wherein the visible indicator is not visible from the exterior of the associated building when the siding or other item is finally installed on the building. Such means should be cost-effective and convenient to implement. Moreover, such means should not significantly affect the structural characteristics or performance of the siding. The method and means for identifying the siding or other item preferably provides a means for presenting advertising regarding the siding or other item.

SUMMARY OF THE INVENTION

The present invention is directed to an exterior building component for installation on a building. The component has a front surface which faces away from the building when the component is installed on the building, an underlap portion, and a nail hem forming a part of the underlap portion. The underlap portion is hidden from view when the component is fully installed on the building. The component has a strip of laminar material affixed to the front surface and extending along at least a portion of the underlap portion. The strip has a prescribed color corresponding to a manufacturer or supplier, whereby the component may be identified as a product of the manufacturer or supplier.

The strip of laminar material may include a coating bonded to the front surface. Preferably, the coating is substantially opaque and is PVC-compatible. Preferably, the coating is from about 0.5 to 1 mil thick. The component may have an embossment in the underlap portion. The coating overlies the embossment and follows the contours of the embossment so that the shape of the embossment is visible.

Alternatively, the strip of laminar material includes a coherent tape web adhered to the front surface. Preferably, the tape web is formed of PVC-compatible material.

The component may include prescribed secondary indicia forming a part of said strip. The secondary indicia correspond to the manufacturer or supplier. Preferably, the strip is from about 0.5 to about 1 inch wide. The underlap portion may include a locking lip arranged and configured to interlock with an adjacent exterior siding component.

The component may be a siding panel, a gutter, a downspout, a window lineal, a gable louver, a trim corner, a shutter, or a roofing shingle.

The present invention is further directed to an exterior building component for installation on a building as follows. The component includes at least a portion thereof being of a prescribed color. The color corresponds to a manufacturer or supplier, whereby the component may be identified as a product of the manufacturer or supplier. Preferably, the component has a front surface which faces away from the building when the component is installed on the building. The portion of prescribed color is disposed on the front surface.

The component as just described may include a substrate. The portion includes a strip of laminar material affixed to the substrate. Preferably, the strip is from about 0.5 to about 1 inch wide. The strip of laminar material may include a coherent tape web adhered to the substrate, preferably formed from PVC-compatible material. Alternatively, the strip of laminar material may include a coating bonded to the substrate, also preferably formed of PVC-compatible material. Preferably, the coating is from about 0.5 to about 1 mil thick. An embossment may be formed in the underlap portion. The coating overlies the embossment, the coating following the contours of the embossment so that the shape of the embossment is visible. Prescribed secondary indicia corresponding to the manufacturer or supplier may form a part of the strip.

The present invention is further directed to an exterior building component for installation on a building as follows. The component has a front surface which faces away from the building when the component is installed on the building, an underlap portion, and a nail hem forming a part of the underlap portion. The underlap portion is hidden from view when the component is fully installed on the building. The component has prescribed indicia affixed to the front surface and extending along at least a portion of the underlap portion. The indicia corresponds to a manufacturer or supplier, whereby the component may be identified as a product of the manufacturer or supplier.

The present invention is further directed to a method for forming an exterior building component which may be identified as corresponding to a manufacturer or supplier in the absence of associated packaging. The method includes forming a colored portion on the component. The color of the colored portion corresponds to the manufacturer or supplier, whereby the component may be identified as a product of the manufacturer or supplier. The step of forming a colored portion may include affixing a strip of laminar material to the component, the laminar material being of the prescribed color. The step of affixing a strip may include applying a coating of colored material to a surface of the component. Further, the step of applying a coating may include transferring the coating from a backing onto a surface of the component. Prescribed secondary indicia may be printed on the underlap portion, the secondary indicia corresponding to the manufacturer or supplier.

The method as described above may include forming a substrate having a front surface which faces away from the building when the component is installed on the building, an underlap portion, and a nail hem forming a part of the underlap portion. The underlap portion is hidden from view when the component is installed on the building. The step of forming a colored portion includes affixing a strip of laminar material to at least a portion of the underlap portion such that the strip extends therealong, the strip being of the prescribed color. A coating of colored material may be applied to the front surface of the component.

The present invention is further directed to a method of providing exterior building component identification for distribution under multiple brands. The method includes selecting a different color for each of the brands. A strip of colored material is applied to each exterior building component, the color of the strip being that of the respective brand under which the respective exterior building component is to be distributed. Preferably, each strip of colored material is applied along an underlap portion of the respective exterior building component. The method may further include the step of applying secondary indicia to each exterior building component corresponding to the brand.

DETAILED DESCRIPTION OF THE PREFERRED EMBODIMENTS

Figure 2:
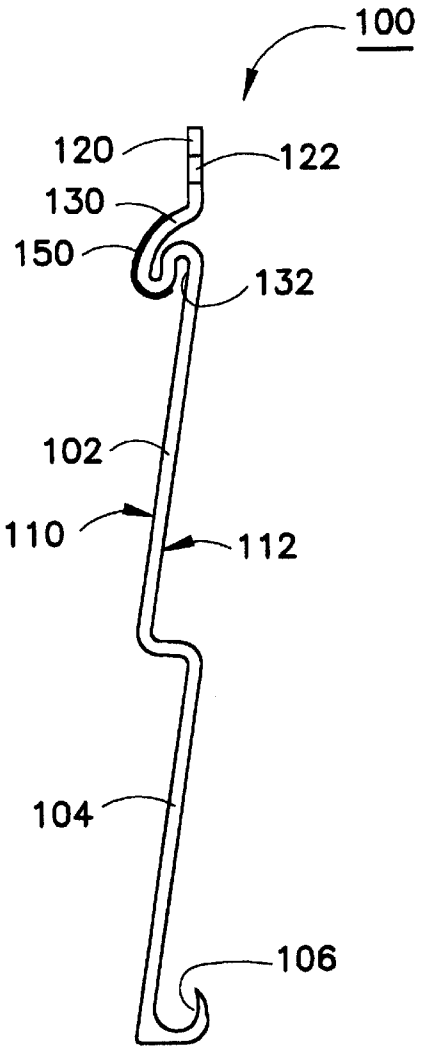
FIG. 2 is a side elevational view of the panel of FIG. 1.
Figure 1:
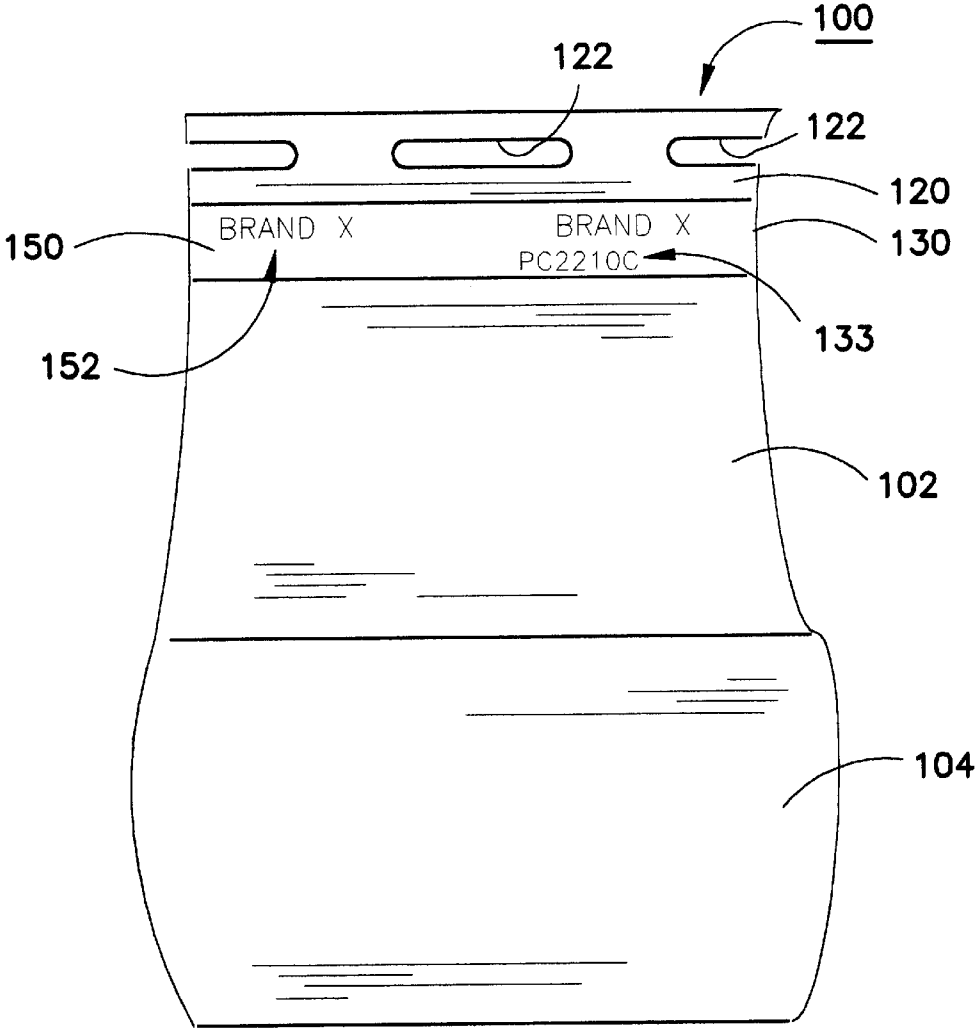
FIG. 1 is a partial, front elevational view of a siding panel according to a first embodiment of the present invention.
Figure 3:
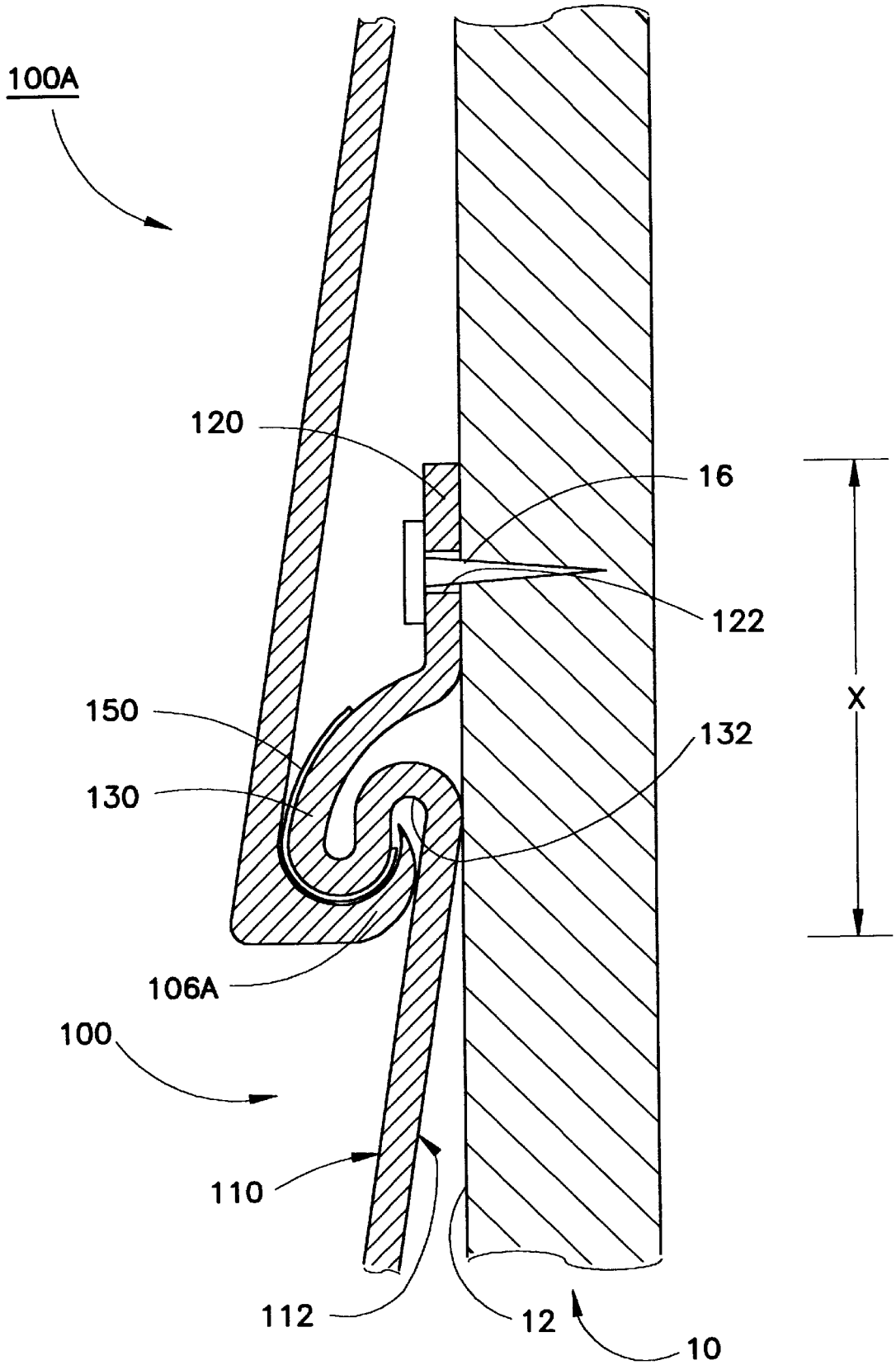
FIG. 3 is a fragmentary, side, cross-sectional view of a pair of panels according to the first embodiment mounted on a building in overlapping arrangement.

With reference to FIGS. 1–3, an exterior siding panel according to the present invention and generally denoted by the numeral 100 is shown therein. As discussed in more detail below, panel 100 is characterized by the provision of a colored identification strip 150 disposed along the length of panel 100 in a location not visible when the panel is mounted on a wall in interlocking relationship with a similar panel.

Panel 100 is preferably formed from extruded polyvinyl chloride (PVC). In conventional fashion, panel 100 includes a continuous formed piece defining a lower locking lip 106*a*, nail hem 120, and a locking lip 130, and may also include various other plank-like designs such as an upper section 102 and a lower section 104. Nail hem 120 has nail slots 122 defined therein. Locking lip 130 defines channel 132. Locking lip 130, channel 132, and locking lip 106 are relatively sized and configured to allow for interlocking as shown in FIG. 3 when the panels are mounted in appropriate fashion, either horizontally or vertically. As can be seen, the locking lip 106 is an exposed locking lip in the completed assembly. Panel 100 has rear surface 112 which, when panel 100 is properly mounted on building 10 as shown in FIG. 3, is disposed adjacent the outer wall 12 of a building 10 and a front surface 110 which faces away from outer wall 12. Panel 100 has a wood grain or similar texture embossed on the front surface thereof. Panel 100 also has embossed therein a lot or run number 133.

As shown in FIG. 3, panel 100 is mounted on outer wall 12 by inserting nails 16 through nail slots 122 and positioning an above-mounted siding panel 100*a* such that the lower portion thereof overlaps the upper portion of panel 100. Lower locking lip 106*a* of panel 100*a* seats within channel 132 of locking lip 130. In this way, the lower edge of upper panel 100*a* is held adjacent the building while hiding the nails, nail hem, and locking lip 130 of panel 100. Accordingly, the locking lip 130 may be referred to as a hidden locking lip. When the panels are so mounted on the building, an underlap portion of panel 100 is defined extending through dimension X of FIG. 3. It will be appreciated that the underlap portion of panel 100 is not visible from the front side of panel 100 (i.e., from the exterior of the building).

As shown, strip 150 is a coating which extends along locking lip 130 on the front surface of panel 100. It will be appreciated from the comments which follow that strip 150 may extend onto all or a part of nail hem 120 in addition to or as an alternative to being disposed on locking lip 130.

Strip 150 is preferably of a color which provides a distinct contrast with the color of the remainder of the panel. Strip 150 is preferably substantially opaque so that the vinyl underlying the strip is not visible from the front of the panel. Notably, however, run numbers 133 embossed in the panel may be discerned because strip 150 follows the contours of the panel front surface. Suitable indicia 152 such as printed brand names or logos may be disposed within strip 150. The width of strip 150 is preferably from about ½ to about 1 inch. Preferably, strip 150 extends continuously along the entire length of panel 100, but gaps may be defined along the strip if desired.

For a given panel 100, the color of strip 150 is chosen to represent a particular source. Typically, the color of the strip would identify a particular manufacturer. Alternatively, where the manufacturer produces the panel for private labelling, the color may be chosen to signify a particular supplier who desires to be recognized as the source of the panel. Further, various styles or product lines of a given manufacturer or supplier may have different prescribed colors of strips associated therewith.

It is important that the visual identifying strip 150 be provided on the front surface of the panel. For example, it is common for siding to be applied to only part of a building in a given day with the installer returning later to install further siding. If the identifying strip were provided on the rear surface of the siding only, then the installer could not easily identify the already installed siding. Hence, there is a risk that the installer will complete the installation with siding which does not match that already installed. The identifying strip provided on the front surface of the panel insures that the installer can readily identify the siding already installed. Further, it is desirable for marketing and brand recognition that the color strip be visible to passersby (e.g., from the road) of a partially completed installation, in displays and marketing tools, and in advertisements.

On the other hand, it is important that the strip 150 not be visible when the panel is fully installed on the building so that it does not detract from the overall appearance of the siding. In the present invention, these competing concerns are addressed by the provision of the colored strip on the front surface of the underlap portion.

Strip 150 is a thin (preferably from about 0.5 to 1 mil) laminate which substantially permanently bonds to the front surface of the vinyl panel. The nature of strip 150 will be better appreciated from the description of the method and materials used to form panel 100, below.

Figure 4:
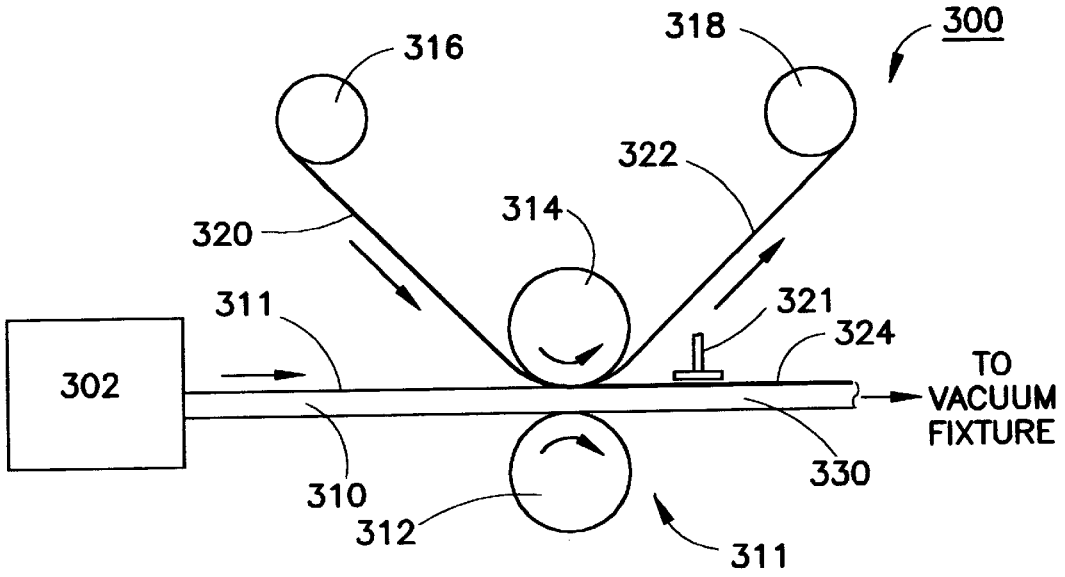
FIG. 4 is a schematic diagram of an apparatus for applying the laminate of the first embodiment to the panel.

With reference to FIG. 4, vinyl extrudite 310 exits extruder 302 as is conventional in the manufacture of vinyl siding. Extrudite 310 has upper surface 311 and is typically a flat, hot sheet at a temperature of about 300–425° F. Extrudite sheet 310 enters embossing stand 311 and passes between metal embossing roll 314 and rubber opposition roll 312. Embossing roll 314 has the mirror image of the embossment pattern (e.g., wood grain) which is to be embossed on the front surface of the panel. Concurrently with the flow of extrudite sheet 310 through embossing stand 311, transfer web 320 is unwound from unwind stand 316.

Figure 5:
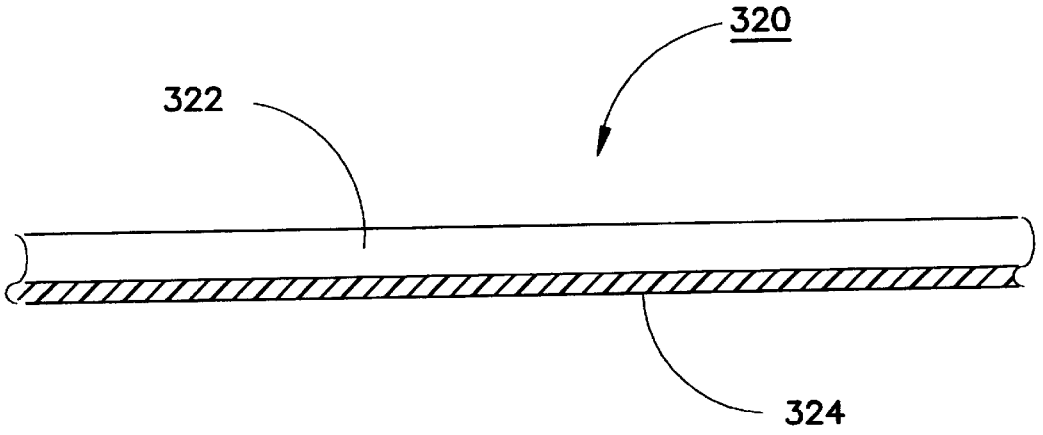
FIG. 5 is a partial, side elevational view of a laminate transfer web as used in the apparatus of FIG. 4.

With reference to FIG. 5, web 320 includes carrier or backing 322 preferably formed of polyester. Backing 322 has colored film 324 on the lower surface thereof. Film 324 contains coloring pigments of the prescribed color along with a suitable agent or material for holding the pigments to the front surface of the vinyl sheet. Preferably, film 324 is a mix of organic pigment and acrylic. Suitable products for web 320 are available from Avery-Dennison Corporation. While other materials may be used, they should be rigid PVC-compatible. That is, if and when a section of the extruded sheet is reground and recycled into the extrusion process, the materials of film 324 must not contaminate the PVC mixture. Other suitable rigid PVC-compatible materials will be appreciated by those of ordinary skill in the art upon a reading of the description herein. Where it is desired to apply indicia 152, the indicia is preferably disposed in film 324.

Transfer web 320 passes between the periphery of embossing roll 314 and upper surface 311 of extrudite sheet 310 such that film 324 interfaces with upper surface 311. The bonding agent of film 324 is chosen such that the latent heat of sheet 310 causes the agent, for example, acrylic, to melt and bond with the upper surface of the vinyl. Restated, film 324 is applied to the vinyl by a heat-activated lamination process. As this occurs, film 324 is transferred from backing 322 and remains with the upper surface 311 of the sheet 310. The transfer of the film from the backing to the vinyl sheet is facilitated by the pressure of embossing roll 314. Because film 324 is transferred as a laminate to the upper surface of sheet 310 as the wood grain texture is being embossed on the sheet, the texture is also present in the film or laminate 324 on the exiting, embossed sheet 330. Thereafter, run numbers 133 are stamped into sheet 330 at locations corresponding to locking lip 130 by stamping station 321. The sheet thus formed thereafter passes to a conventional vacuum fixture where it is given its overall general shape. Thereafter, the vinyl panel is processed in conventional manner. Backing 322 is taken up on rewind stand 318.

It will be appreciated that the method as described provides several distinct advantages. As noted, the proper selection of materials for strip 150 allows the panel having such a strip thereon to be reground and recycled without deteriorating the quality of the recycled mixture. Typically, a first length of a given extrusion run is of poor quality and must be recycled. Hence, the ability to recycle the initial extrudite, notwithstanding the presence of strip 150, provides significant savings in material needs. Further, the method for applying strip 150 does not in any way slow the manufacturing process. The application of the strip does not require a separate step, but is instead accomplished concurrently with the conventional step of embossing the upper surface of the extruded sheet. Further, the application of the strip does not limit the speed of the embossing process. A significant advantage of the process and equipment used to apply film 324 is that the colors (as well as trademarks, logos, and other designations of origin) of the strip 150 may be easily and cost-effectively changed by simply changing the web 320 provided between stands 316,318.

It will be appreciated from the foregoing that identification strip 150 does not affect the structural or performance characteristics of the panel. Hence, the presence of strip 150 as described need not be accounted for in the performance engineering of the panel.

Figure 7:
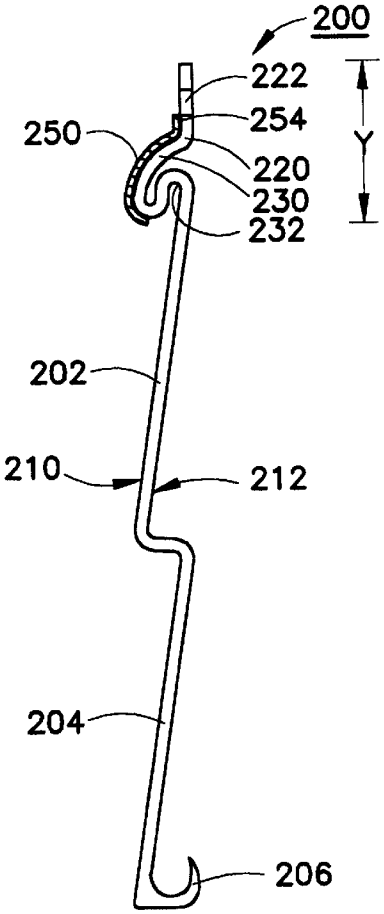
FIG. 7 is a side, elevational view of the panel of FIG. 6.
Figure 6:
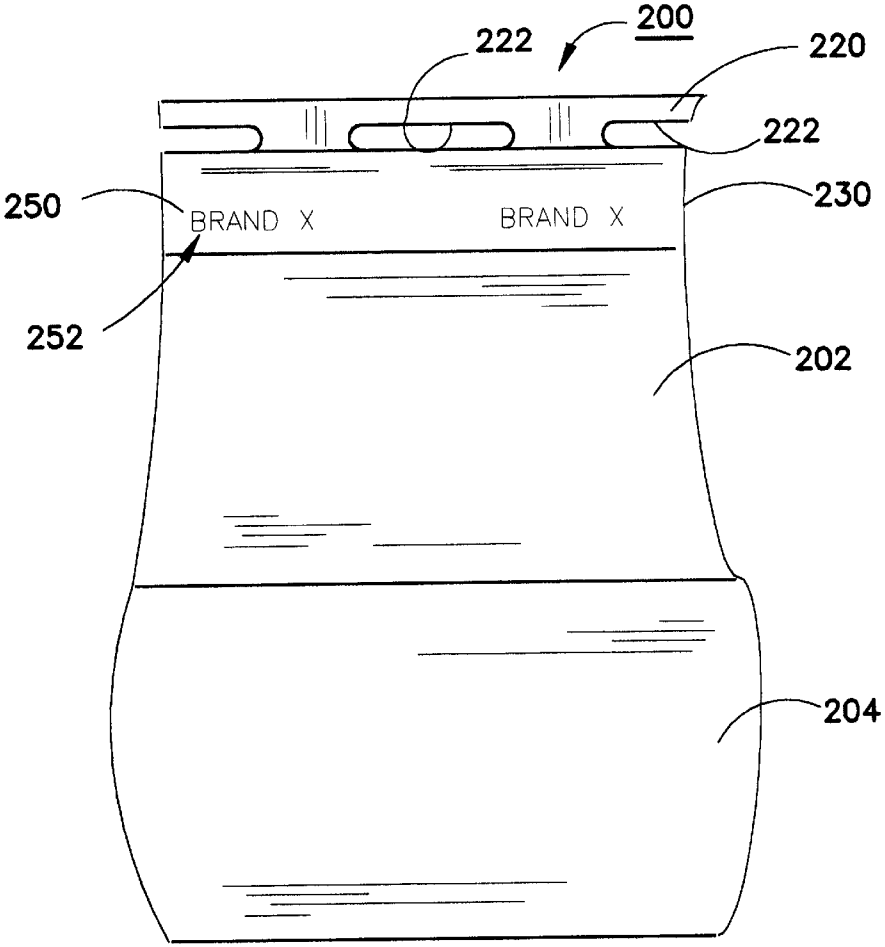
FIG. 6 is a partial, front elevational view of a siding panel according to a second embodiment of the present invention.

A panel 200 according to a second embodiment of the present invention is shown in FIGS. 6 and 7. Elements 202, 204, 206, 210, 212, 220, 220, 230 and 232 correspond to elements 102, 104, 106, 110, 112, 120, 122, 130 and 132, respectively, of panel 100 according to the first embodiment. Panel 200 has an underlap portion extending through dimension Y and corresponding to the underlap portion of panel 100. Panel 200 differs from panel 100 in that identification strip 250 is a coherent tape web adhered to the front surface of the panel by adhesive 254. Also, strip 250 extends up onto a portion of nail hem 220. The tape web of strip 250 should be formed from a rigid PVC-compatible material, and is itself preferably PVC. Strip 250 may be provided in a self-adhesive backed form and applied to the panel, or adhesive may be applied to the panel followed by application of the tape web to the adhesive. Strip 250 may be provided with suitable indicia 252 corresponding to indicia 152 of the first embodiment. As an alternative to the above, indicia corresponding to indicia 152,252 may be printed along the front surface of the underlap portion without provision of colored strips 150,250 as described. This would provide an identification for the panel when it is separated from its packaging and even mounted on a wall, while still not detracting from the appearance of the siding once it has been fully installed on the building. However, the panel will be ore readily identified if a contrasting color strip as described above is provided.

From the foregoing, it will be appreciated that each of the techniques above using strips of prescribed colors and/or indicia corresponding to given manufacturers, suppliers, or styles may be employed with other trim items used to complete the installation of exterior siding on a building. Trim items having underlap portions corresponding to that of the siding panel or otherwise concealed portions may include soffits, gutters, downspouts, window lineals, gable louvers, and shutters. Further, it will be appreciated that these techniques may be employed with aluminum siding panels and other components with appropriate modifications.

It will be appreciated that the siding as described is "fully" installed on a building when the trim accessories necessary to conceal the underlap portions have been mounted. For example, a given siding panel is fully installed when it is secured to the building by nails or the like and the underlap portion thereof is covered by an adjacent overlapping siding panel or other trim item such as comer trim.

The colored strip of the present invention may also be advantageously employed for roofing shingles. A colored strip and/or indicia corresponding to a given manufacturer or supplier is positioned along the underlap portion of the shingle adjacent or on the adhesive of the shingle. Prior to complete installation of a roof, the manufacturer or supplier of the last row of shingles can be identified by the strip. When the roof is fully installed, all of the strips are covered by the respective succeeding, overlapping shingles.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed is:

1. An exterior building component for installation on a building exterior comprising:

a front surface of the component which faces away from the building when said component is installed on the building, an underlap portion of the component which is hidden from view when said component is installed on the building.

an exposed portion of the component which is exposed to view when the component is installed on the building.

a strip of laminar material affixed to said front surface and extending along at least a portion of said underlap portion and not extending to any part of the exposed portion, said strip having a prescribed color corresponding to a supplier, wherein said strip of laminar material includes a coherent tape web adhered to said front surface, whereby said component may be identified by the presence of the strip as a product of the supplier.

2. The component of claim 1 wherein said tape web is formed of PVC-compatible material.

3. An exterior building component for installation on a building exterior comprising:

a front surface of the component which faces away from the building when said component is installed on the building, an underlap portion of the component which is hidden from view when said component is installed on the building.

an exposed portion of the component which is exposed to view when the component is installed on the buildings, a strip of laminar material affixed to said front surface and extending along at least a portion of said underlap portion and not extending to any part of the exposed portion, said strip having a prescribed color corresponding to a supplier, wherein said strip of laminar material includes a coating bonded to said front surface and said coating is from about 0.5 to 1 mil thick, whereby said component may be identified by the presence of the strip as a product of the supplier.

4. An exterior building component for installation on a building exterior comprising:

a front surface of the component which faces away from the building when said component is installed on the building, an underlap portion of the component which is hidden from view when said component is installed on the building and, having an embossment, an exposed portion of the component which is exposed to view when the component is installed on the building, a strip of laminar material affixed to said front surface and extending along at least a portion of said underlap portion and not extending to any part of the exposed portion, said strip having a prescribed color corresponding to a supplier, wherein said strip of laminar material includes a coating bonded to said front surface and wherein said coating overlies said embossment, said coating following the contours of said embossment so that the shape of said embossment is visible, whereby said component may be identified by the presence of the strip as a product of the supplier.

5. An exterior building component for installation on a building exterior comprising:

a front surface of the component which faces away from the building when said component is installed on the building, an underlap portion of the component which is hidden from view when said component is installed on the building, wherein said underlap portion includes a locking lip arranged and configured to interlock with an adjacent exterior siding component, an exposed portion of the component which is exposed to view when the component is installed on the building, a strip of laminar material affixed to said front surface and extending along at least a portion of said underlap portion and not extending to any part of the exposed portion, said strip having a prescribed color corresponding to a supplier, whereby said component may be identified by the presence of the strip as a product of the supplier.

6. An exterior building installation comprising:

first and second building components, each of the first and second building components having:

a front surface of the component which faces away from the building as the component is installed on the building, the front surface of each of the first and second components having an underlap portion and an exposed portion, the underlap portion of each component having a strip of laminar material affixed to said front surface and not extending to any part of the exposed portion, said strip having a prescribed color corresponding to a supplier, the first and second components being installed on the building such that the underlap portion of the first component is covered by the exposed portion of the second component and the exposed portion of the second component is at least momentarily uncovered whereby the second component may be identified by the visible strip as a product of the supplier.

7. The component of claim 6 wherein said strip of laminar material includes a coating bonded to said front surface.

8. The component of claim 7 wherein said coating is substantially opaque.

9. The component of claim 7 wherein said coating is PVC-compatible.

10. The component of claim 6 including prescribed secondary indicia forming a part of said strip, said secondary indicia corresponding to the manufacturer or supplier.

11. The component of claim 6 wherein said strip is from about 0.5 to about 1 inch wide.

12. The component of claim 6 wherein said component is a siding panel.

13. The component of claim 6 wherein said component is at least one of a gutter, a downspout, a window lineal, a gable louver, a trim corner and a shutter.

14. The component of claim 6 wherein said component is a soffit panel.

15. The component of claim 6 wherein said component is a roofing shingle.

16. An exterior building installation comprising:

first and second exterior building components, each of the first and second exterior building components having:

a front surface of the component which faces away from the building as the component is installed on the building, the front surface of each of the first and second components having an underlap portion and an exposed portion, the underlap portion of each component having prescribed indicia affixed to said front surface and not extending to any part of the exposed portion, said indicia corresponding to a supplier, the first and second components being installed on the building such that the underlap portion of the first component is covered by the exposed portion of the second component and the exposed portion of the second component is at least momentarily uncovered whereby the second component may be identified by the visible indicia on the exterior of the building as a product of the supplier.

17. A piece of siding for the exterior of a building comprising:

a sheet of polymer material formed into an underlap and an exposed portion, the exposed portion resembling a siding board including having an embossed wood-grain texture and an exposed locking lip, the underlap including a hidden locking lip and a nail hem, the hidden locking lip protruding from the sheet and having an indicator of the supplier of the piece of siding, the indicator being visible when the hidden locking lip is uncovered and not visible when the hidden locking lip is covered by an exposed locking lip of a subsequently installed piece of siding, whereby as multiple ones of the piece of siding are mounted onto an exterior of a building, the most recently mounted piece will have its hidden locking lip uncovered to show the indicator of the supplier of the piece of siding, and the mounting of a subsequent piece of siding will cover the previously-uncovered hidden locking lip by its exposed locking lip and show the hidden locking lip of the newly installed piece of siding.

* * * * *